United States Patent [19]

Bernhart et al.

[11] Patent Number: 4,717,993

[45] Date of Patent: Jan. 5, 1988

[54] ALIGNING JOINING MECHANISM FOR LUMINAIRES

[75] Inventors: Horst Bernhart, Ontario; Kingsley Chan, Rolling Hills Estate, both of Calif.

[73] Assignee: Lightolier Incorporated, Secaucus, N.J.

[21] Appl. No.: 46,105

[22] Filed: May 5, 1987

[51] Int. Cl.[4] ..... F21S 1/02

[52] U.S. Cl. ..... 362/219; 362/368; 362/404

[58] Field of Search ..... 362/219, 225, 368, 404; 403/331

[56] References Cited

U.S. PATENT DOCUMENTS

| | | | |
|---|---|---|---|
| 2,219,383 | 10/1940 | Dillon | 362/219 |
| 2,990,470 | 6/1961 | Bodian et al. | 362/219 |
| 3,011,047 | 11/1961 | Spaulding | 362/219 |
| 3,019,332 | 1/1962 | Schiffer | 362/219 |
| 4,419,717 | 12/1983 | Price et al. | 362/404 |
| 4,424,554 | 1/1984 | Woloski et al. | 362/404 |

*Primary Examiner*—George L. Walton

*Attorney, Agent, or Firm*—Arthur B. Colvin

[57] ABSTRACT

An aligning and joining mechanism for coupling and forcing the abutting ends of fluorescent luminaires into intimate engagement comprises a spanning member extending from one luminaire slidably into a receiver on the other luminaire. The spanner member includes a cam surface disposed adjacent a threaded component on the receiver. When the threaded component is driven against the cam portion, the inclination of the cam causes the abutting ends of the luminaires to be tightly compressed one against the other.

8 Claims, 4 Drawing Figures

ALIGNING JOINING MECHANISM FOR LUMINAIRES

BACKGROUND OF THE INVENTION

1. Field of the Invention

The present invention is directed to improvements in lighting fixtures of the luminaire type and relates more particularly to an aligning and joining mechanism for securing luminaires in end to end abutting relation in commercial and industrial installations.

2. Prior Art

It is conventional in fluorescent installations and particularly in installations of a commercial or industrial nature where it is required to illuminate extended expanses, to effect such illumination utilizing a large number of end to end connected fluorescent fixtures or luminaires suspended from the ceiling at spaced hanger locations. The installation is often comprised of individual fixtures which may be eight or more feet in length. The fixtures which may radiate light upwardly against the ceiling or downwardly toward the work area may be suspended at heights of ten or more feet from the floor. Heretofor, the connection of such luminaires in end to end abutting relation has required the application of fasteners such as bolts, machine screws, and the like which interconnect the respective sections. Often, the interconnection procedures have required the disassembly of the luminaire structures to gain access to the interiors thereof and the reassembly of the luminaires thus connected. Since interconnection of the various luminaires must be accomplished after the luminaires are suspended from the ceiling structure, it will be evident that such procedure necessitates workmen effecting connection and reassembly of the luminaires while standing on ladders, scaffolds, and like awkward positions.

In addition, it is highly desirable that the interconnection of luminaires result in a structure wherein a precise interfit between adjacent luminaires be accomplished. That is to say, if any spaces exist between adjacent luminaires, light will shine through the apertures or spaces resulting in an unsightly and unworkmanlike appearance of the finished assembly.

SUMMARY OF THE INVENTION

The present invention may be summarized as directed to an improved attachment mechanism for connecting luminaires in end to end abutting relation, normally after they have been suspended in approximately their intended position. More particularly, the invention is directed to an aligning and joining mechanism for luminaires wherein interconnection of adjacent respective luminaires may be effected without the necessity of disassembling the luminaire fixtures and without the use of screws, bolts, or like connecting mechanisms which span adjacent luminaires. Still more particularly, the invention is directed to an aligning and joining mechanism for luminaires wherein connection between adjacent luminaires is effected by the tightening of a single threaded adjustment member which adjustment member in addition to interconnecting the respective luminaires functions to draw the abutting luminaires into tight end to end engagement, thereby assuring that there will be no cracks or spaces at the interface between the abutting luminaires.

Still more particularly, the present invention is directed to an aligning and joining mechanism for luminaires which includes a spanner member fixed to one of said luminaires, the spanner member including a projecting portion which may be sleeved into a complemental receiver member previously secured to the next adjacent luminaire. The spanner member includes a cam portion, which when the projecting portion is mounted in the receiver member, underlies a threaded element mounted on the receiver member. Tightening of the threaded member results in projecting a lead portion of the threaded member against the cam member, whereby when the threaded member is progressively tightened, the lead portion engages the cam member functioning progressively to draw the receiver member toward the previously mounted luminaire until the two luminaire sections are wedged in end to end abutting relation.

As will be apparent from the preceding general description, there is provided in accordance with the invention an aligning and joining mechanism for fluorescent luminaires wherein interconnection is effected by actuation of a single threaded member, the threaded member being accessible without disassembly of the luminaire components. Tightening of the threaded member functions not only to lock the luminaire sections together, but also functions to draw the sections into intimate end to end abutting relation providing a neat and space free interconnection between adjacent luminaires.

It is accordingly an object of the invention to provide an aligning and joining mechanism for fluorescent luminaires which enables connection between adjacent luminaires by a simple tightening action of a single threaded member. A further object of the invention is the provision of a device of the type described which in addition to locking the luminaires in end to end abutting relation functions to draw the abutting end portions of the luminaires into tight inter-engaged relation. Still a further object of the invention is the provision of a device of the type described wherein the aligning and joining mechanism may also function as a receiver for hanger rods which support the luminaires from the ceiling structure.

BRIEF DESCRIPTION OF THE DRAWINGS

The invention will be more clearly understood from a description of the accompanying drawings wherein.

DETAILED DESCRIPTION OF THE DRAWINGS

Figure 1:
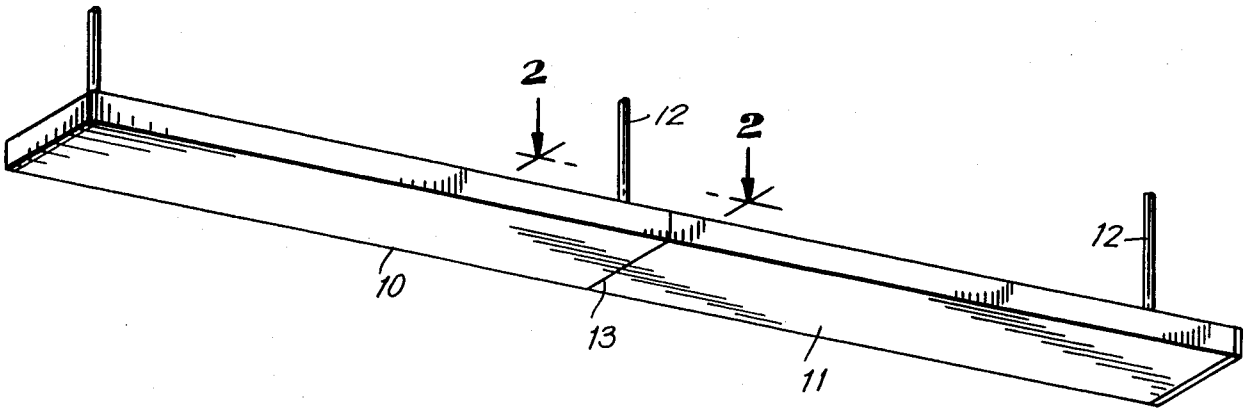
FIG. 1 is a perspective view of a pair of luminaires connected in end to end abutting relation.

Referring now to the drawings, there is disclosed in FIG. 1 an installation comprised of a pair of fluorescent luminaires 10 and 11 suspended from hanger rods 12, the upper ends of the hanger rods being secured in conventional fashion to the ceiling structure above the luminaires. It will be understood that while only two luminaires have been disclosed in FIG. 1, which luminaires meet at abutment line 13, that a given installation may include any desired number of end to end connected luminaires.

Figure 2:
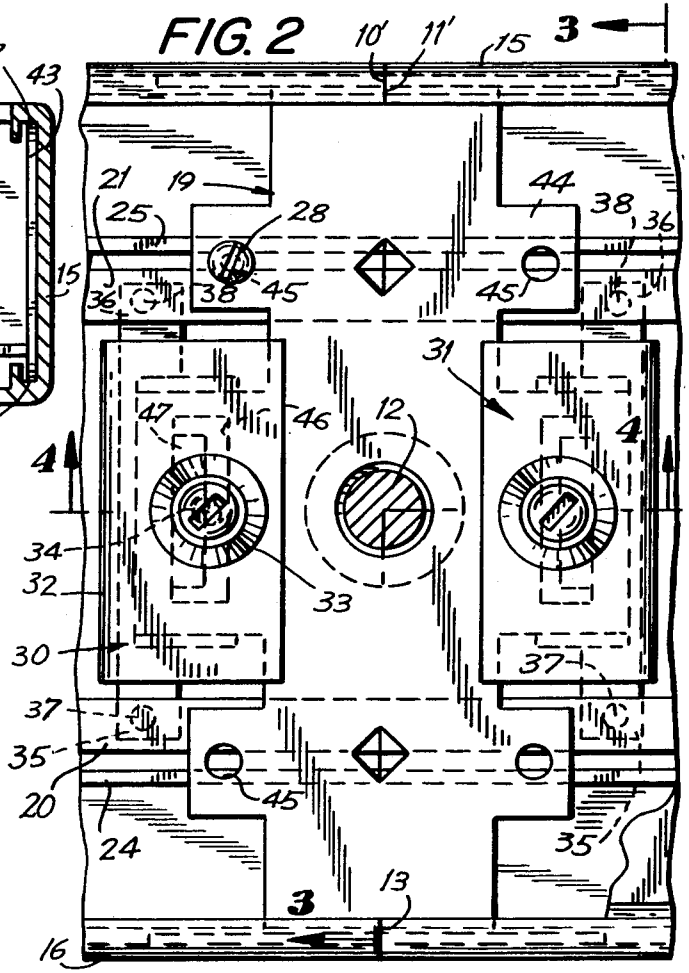
FIG. 2 is a magnified vertical section taken on the line 2—2 of FIG. 1.
Figure 3:
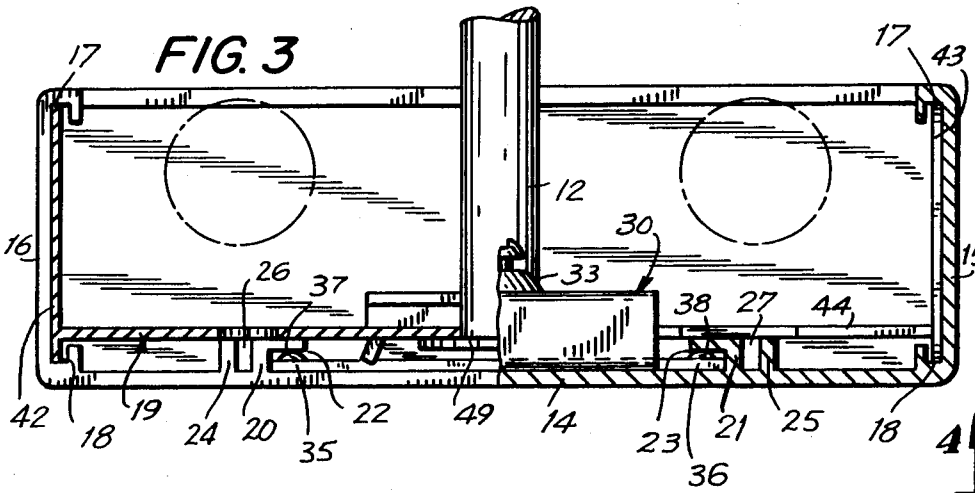
FIG. 3 is a discontinuous section taken on the line 3—3 of FIG. 2.

As best seen in FIGS. 2 and 3, the luminaires 10 and 11 may be comprised of aluminum extrusions which are generally u-shaped in transverse section, the extrusions including a central web 14 having upwardly projecting arms 15, 16 at the lateral side edges of the web. The arms 15, 16 may include at their upper and lower extremities opposed channels 17, 18 respectively for the reception of the spanner member 19 as will be more fully described hereafter. The extrusion from which luminaires 10, 11 is formed also includes an upstanding pair of L-shaped guide members 20, 21 defining inwardly directed opposed longitudinally extending slots 22, 23 respectively. The extrusions include vertically directed longitudinally extending flanges 24, 25 spaced from members 20 and 21 respectively, the space 26, 27 between members 20, 24 on the one hand and 21, 25 on the other defining a screw-way within which machine screws 28 may be mounted as will be more fully described hereinafter.

The structure of the luminaire as thus far described forms no part of the instant invention, but rather has been set out in detail in order to permit an appreciation of the manner in which the aligning joining mechanism forming the invention co-acts with the luminaire. In this context it should be understood that other luminaire configurations may readily be adapted for use with the aligning joining mechanism next to be described and details of the aligning joining mechanism may be readily adapted to co-act with such other luminaire configurations.

Referring again to the drawings, the luminaires 10, 11 adjacent their respective abutting ends 10', 11' are provided with receiver members 30 and 31 respectively. Since the receiver members 30 and 31 are identical, a description of one such member will suffice. More particularly, the receiver member 30 includes a locking plate 32 having an upstanding boss 33 including a threaded aperture 34. The receiver member 30 includes laterally directed flanges 35, 36 mounted within the slots 22, 23 formed on the base of the extrusion. Preferably, the flanges 35, 36 incorporate upstanding projections 37, 38 which closely fill slots 22, 23 respectively to provide frictional but sliding engagement of the flanges within slots 22, 23.

As is best appreciated from FIG. 2, the receiver members 30, 31 are spaced a short distance inwardly from the abutment line 13 between adjacent luminaires.

The linking of the adjacent receiver members 30 and 31 is effected by a spanner member 19, the details of which will now be described. Spanner member 19, which is generally u-shaped in transverse section, includes upstanding side flanges 42, 43 the extremity of the flanges 42, 43 projecting above and below the base portion 44 of the spanner member. As will be apparent from FIG. 3, the flanges 42, 43 of the spanner are received within the opposed slots 17, 18 in the arms 15 and 16 of the extrusion. Optionally but preferably, the base plate 44 may include apertures 45 which register with the screw way and are anchored into the screw way by the previously described sheet metal screws or machine screws 28. As will be appreciated from the ensuing discussion, the spanner member 19 is anchored either to one or the other of the luminaires, in the illustrated embodiment to the luminaire 10, it being the function of the aligning joining mechanism to permit anchoring of the spanner to the opposite luminaire, i.e. luminaire 11, after the respective luminaires have been supported from the ceiling structure.

The base plate 44 of the spanner includes an aperture 46 formed therethrough, a depending tongue 47 formed of the material of the base plate and defining a cam portion being deflected downwardly through the aperture of the spanner. Optionally but preferably, the spanner base plate 44 may include a central mounting aperture 48 within which the headed portion 49 of hanger rod 12 is mounted. The connection of the rod to the spanner member base plate may be effected in any desired means and forms no part of the present invention.

Figure 4:
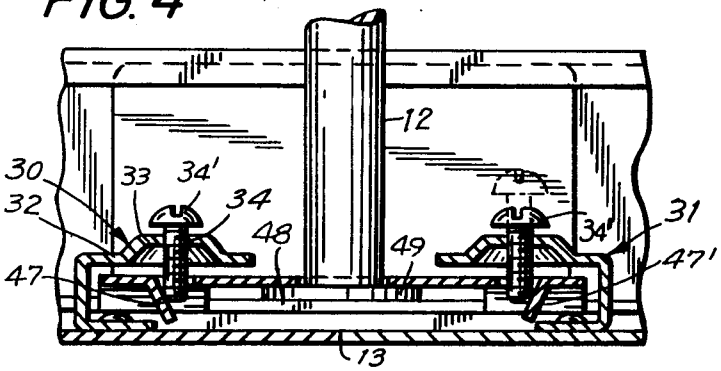
FIG. 4 is a section taken on the line 4—4 of FIG. 2.

The operation of the device would be appreciated from the preceding description. In the course of erecting a luminaire assembly, the receiver members 30 and 31 are previously affixed in the manner described adjacent the abutting edges 10', 11' of the respective luminaires 10 and 11. The spanner member 19 is secured to one or the other of the luminaires (illustratively by connection to the receiver member 30). This connection is effected by sliding the base plate 44 of the spanner member to a position beneath the locking plate 32 of the receiver member 30 in such manner that the cam portion 47 of the spanner member underlies the threaded member 34' mounted in threaded aperture 34. With the parts thus positioned, the threaded 34' is rotated so as to be driven downwardly against cam surface 47 as shown in FIG. 4. Auxiliary locking means for positioning the spanner relative to luminaire 10 such as machine screw 28 may be employed to securely position the spanner member relative to luminaire 10. The luminaire 10 with the hanger rod 12 supporting same prepositioned may be mounted to the ceiling in the usual manner.

In order to effect mounting of luminaire 11, it is merely necessary to support one end by its respective hanger 12. Thereafter, the abutting edge 11' of luminaire 11 is shifted toward edge 10' of luminaire 10 and the mounting plate 44 of spanner member advanced to a position beneath the threaded member 34' of the receiver 31. It will be understood that in order to permit the plate 44 to slide to a position as shown in FIG. 4, the threaded member 34' of receiver 31 must be in the raised or dotted line position shown in FIG. 4.

It will be appreciated that in the course of sliding the plate 44 into receiver member 31 the upstanding legs 42, 43 of the spanner member will slide into the corresponding slots 17, 18 of the luminaire 11.

The luminaires are thereafter shifted into a position where at the end portions 10', 11' of the respective luminaires approach as closely as possible an abutted position. With the luminaires thus disposed, final adjustment is achieved by threading the bolt 34' of receiver 31 downwardly into engagement with cam 47'. With continued downward threading movement, the luminaire 11 will be camed toward luminaire 10 until a wedged or locking position is achieved by the engagement of the ends 10', 11' of the respective luminaires (FIG. 4). It will thus be observed that tightening of the threaded member 34' of receiver 31 not only functions to lock the two luminaires against separation in a horizontal direction, but also functions to shift the abutting edges of the two luminaires into intimate space free contact.

As will be recognized from the above description, the alignment of the respective luminaires is effected principally as a result of the sliding engagement of the side arms of the spanner member with the opposed slots of the respective extrusions, the cam locking function being primarily to prevent separation of the respective luminaires and to assure intimate contact of the abutting edges thereof. As will further be apparent, the final steps of assembling luminaire 11 to luminaire 10 involves merely the tightening of a single threaded member, a task which may readily be accomplished by a worker standing on a ladder or scaffold and certainly far easier than methods heretofor employed which require disassembly, subsequent connection, and reassembly while the worker is on the ladder or scaffold.

Numerous variations in details of construction may be made to the specific embodiments herein disclosed without departing from the spirit of the present invention. Accordingly the same shall be broadly construed within the scope of the appended claims.

Having thus described the invention, what is claimed as new and sought to be protected by Letters Patent of the United States is:

1. A locking device for shifting into abutting relation and clamping together the adjacent ends of a pair of elongate generally u-shaped fluorescent luminaire fixtures having central webs and upstanding arms, said device comprising first and second receiver members adapted to be secured to said webs of said fixtures in proximate relation to said adjacent ends, each said receiver member including a locking plate in spaced parallel relation to a said web and a threaded member movable toward and away from said web, a spanner member disposed between said receiver members, said spanner member including a base portion in parallel spaced relation to and underlying said locking plates, first and second cam portions formed on said spanner member, said cam portions underlying said threaded members, said cam portions being inclined toward each other and toward said webs, whereby movement of said threaded members toward said webs drives said threaded members against said cam portions and hence shifts said receiver portions toward each other to allow said adjacent ends to be urged into a slidably locked abutting engagement with one another by the movement of said threaded members.

2. A device in accordance with claim 1 wherein said spanner member is generally u-shaped in transversed section, said base portion defining the base of said u-shape and having upstanding flanges at the distal ends thereof spaced to correspond to the interior surfaces of said arms of said fixtures.

3. A device in accordance with claim 2 wherein said base portions includes a mounting aperture disposed between said cam portions for the receipt of a hanger rod or like suspending mechanism.

4. A device in accordance with claim 2 wherein said flanges extend to both sides of the plane of said base portion.

5. In a lighting assembly comprising two fluorescent luminaire fixtures each said fixture comprising an elongate u-shaped housing member having a central web and a spaced pair of upstanding arms, said arms including longitudinally extending channel portions, an aligning clamp device adapted to connect said fixtures in intimate end to end abutting relation comprising a generally u-shaped spanner member including a central base portion having a pair of upstanding flanges at the distal ends thereof, said flanges being sized to be slidably receivable in said channels of said arms, fastener means on one said housing for securing said spanner to said one housing with portions of said base portion and said flanges projecting beyond an end of said one housing, a longitudinal extending cam surface formed on said base portion and projecting beyond said end of said one housing, said cam surface being inclined toward said web of said end portion of said one housing, and a receiver member mounted on said other fixture adjacent an end thereof, said receiver member including a locking plate in spaced parallel relation to said web of said other fixture, a threaded member mounted on said plate for movement toward and away from said web, said threaded member being positioned to register with said cam surface in the end to end abutting position of said fixtures, whereby said other fixture is axially shifted into end to end abutting relation to said one fixture responsive to movements of said threaded member against said cam surface.

6. Apparatus in accordance with claim 5 wherein said fastener means comprises a second said receiver member, the cam surface of said second receiver member being inclined toward said web of said end portion of said other housing.

7. Apparatus in accordance with claim 6 wherein said spanner member includes a mounting aperture disposed between said cam portions and hanger rod means extending through said aperture and connected to said spanner for supporting said fixtures.

8. An aligning and locking device for securing adjacent end portions of a pair of axially elongated fluorescent luminaire fixtures in end to end abutting relation comprising a spanner member fixed to an end of one said fixture and including portions extending there beyond, a receiver member on said other fixture adjacent an end thereof and sized to slidably receive said projecting portion of said spanner member, a cam portion on one said member, threaded means on the other said member, said threaded means being disposed opposite said cam portion in the abutting position of said fixture ends, said cam portion being inclined such that advancing said threaded means against said cam portion slidable urges said ends toward each other in the direction of the axis of said fixtures, whereby said adjacent ends are urged into a slidably locked abutting engagement with one another by the movement of said threaded means.

* * * * *